United States Patent [19]

Diez de Aux

[11] 4,074,903

[45] Feb. 21, 1978

[54] SNOW SKIING SIMULATION APPARATUS

[76] Inventor: Alphonzo Diez de Aux, Suite 4, 1646 Victoria Park Ave., Scarborough, Ontario, Canada, M1R-1P7

[21] Appl. No.: 721,273

[22] Filed: July 8, 1976

[51] Int. Cl.[2] ..... A63G 31/16

[52] U.S. Cl. ..... 272/16; 35/29 R; 272/97

[58] Field of Search ..... 35/29 R, 29 A; 272/97, 272/18

[56] References Cited

U.S. PATENT DOCUMENTS

| | | | |
|---|---|---|---|
| 1,789,680 | 1/1931 | Gwinnett | 272/18 |
| 2,455,274 | 11/1948 | Scriver | 35/29 R X |
| 2,573,808 | 11/1951 | Ravoire | 35/29 R X |
| 3,159,400 | 12/1964 | Brass | 35/29 R X |
| 3,408,067 | 10/1968 | Armstrong | 35/29 R X |
| 3,461,857 | 8/1969 | Poulin | 272/97 X |

*Primary Examiner*—Harland S. Skogquist

[57] ABSTRACT

Apparatus for simulating skiing down a slope including a sloping platform mounted by the user in front of which is projected a picture of a ski slope accompanied by instruction as to how to traverse the slope. Means are connected to the platform for simulating the various movements a skier would execute in skiing down the slope. These movements are executed in accordance with the instruction accompanying the projection.

8 Claims, 5 Drawing Figures

SNOW SKIING SIMULATION APPARATUS

BACKGROUND OF THE INVENTION

This invention relates to an apparatus for simulating snow skiing, and more particularly, to an apparatus which can be used at home or any convenient location to practice various skiing maneuvers on a simulated ski slope.

The neophyte skier, even though training on a shallow slope with the supervision of an experienced professional, encounters many difficulties. Maintenance of balance and the leg and body motion requisite for the execution of a turn are difficult achievements for a beginner. As a result, many falls are experienced, some with injury, and infrequently used muscles become sore from the novel activity. Because of the seasonal nature of the sport and the practical limitations on frequent access to the ski slopes, even experienced skiers lose their touch and are subject to the noted muscle soreness and on occasion have severe falls on the steeper slopes which they traverse. Even an expert skier should have advance knowledge of the slopes he is apt to ski for the first time.

SUMMARY OF THE INVENTION

Accordingly, it is the general objective of the present invention to provide a ski-simulator training apparatus for use by all classes of skiers. The apparatus not only enables accurate reproduction of the body, feet and let motions of a skier so as to provide an excellent training and practice device for a neophyte or intermediate skier, but includes means for an expert skier to familiarize himself with advance knowledge of slopes he has never skied on and to practice skiing down that slope. The apparatus is relatively simple and compact so that it can be readily set up in any room or transported for use at a different location.

Generally, to achieve these objectives, the apparatus includes a sloping platform, simulating a ski slope, on which the skier stands. The platform can be supported on almost any surface and faces a projection screen on which a preselected instruction program is viewed. The program includes the actual slope the skier may ski and is accompanied by sound instructing the skier in the proper mode of skiing down the projected slope, including when and how to execute a turn, etc.

The skier attaches his boots to the harness on the platform and is provided with spring-mounted ski poles suspended from the ceiling or a convenient support. The platform is rocked by electrically operated solenoids to simulate the run down the slope projected on the screen.

The harness connected to each boot is mounted so as to slide back and forth and sideways along roller surfaces and to turn from a horizontal plane through a universal joint mounting, so the skier can execute simulated turns and stops when instructed. If the stop is properly executed, a lever connected to each harness is adapted to strike a switch shutting down the power to the relays to simulate a proper stop. The weight of the skier and each harness is supported on telescopic hydraulic shock absorbers to absorb the deflection of the apparatus and redistribution of the weight of the skier during a simulated turn to simulate the true feeling and motion experienced while turning.

BRIEF DESCRIPTION OF THE DRAWINGS

Further objects and advantages of the invention will become more apparent from the following description and claims, and from the accompanying drawings, wherein:

DETAILED DESCRIPTION OF THE PREFERRED EMBODIMENT

Figure 1:
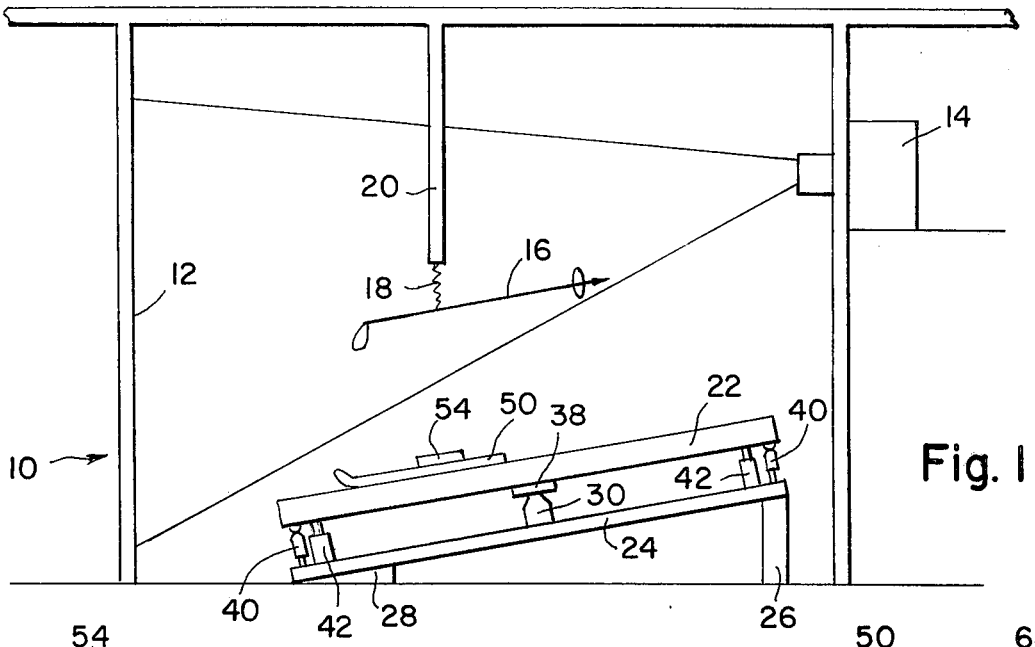
FIG. 1 is a side view in elevation of the ski simulation apparatus of the present invention.

Referring now to the drawing in detail, wherein like numerals indicate like elements throughout the several views, the ski-simulation apparatus 10 of the present invention includes a slide or movie projection screen 12, a slide or movie projector 14, a pair of ski poles 16 mounted by springs 18 or the like from a ceiling-mounted support 20, and a sloping platform 22 supported on a planar board 24 mounted on vertical supports 26 and 28.

Platform 22 is supported on board 24 by a tetrahedron shaped block 30 mounted on board 24 and having sloping sides 32 terminating in a point 34 in contact with concave surface 36 on the bottom of a block 38 depending from the bottom surface of platform 22. Because of this mounting, platform 22 is adapted to be rocked and pivoted about block 30 to simulate the motion experienced when skiing down a slope.

Mounted between the four corners of platform 22 and board 24 are spring-mounted shock absorbers 40 and electrically actuated solenoids 42 whose plungers 44 are connected to the bottom surface of platform 22. Solenoids 42 are adapted to rock, pivot and vibrate platform 22 about block 30 by having their plungers 44 alternately extended and retracted out of phase by, for example, a multi-switch disc turned by an electric motor. The switch disc is programmed to correspond to a timed simulated motion to be imparted to platform 22 as will be more apparent from the description which follows hereinafter. Shock absorbers 40 dampen the vibrations imparted to platform 22 by solenoids 42.

Mounted on the top surface of platform 22 facing screen 12 are a pair of boot-receiving harness assemblies 46 and 48. Each of the assemblies 46 and 48 include an upper boot platform 50 slidably supported on a base plate 52 for reciprocal movement.

The top surface of each upper boot platform 50 includes a U-shaped harness 54 adapted to be locked by conventional ski boot bindings to a ski boot 56 worn by the skier. Extending laterally from each harness 54 is a switch lever 58 for a purpose to be described hereinafter.

Figure 3:
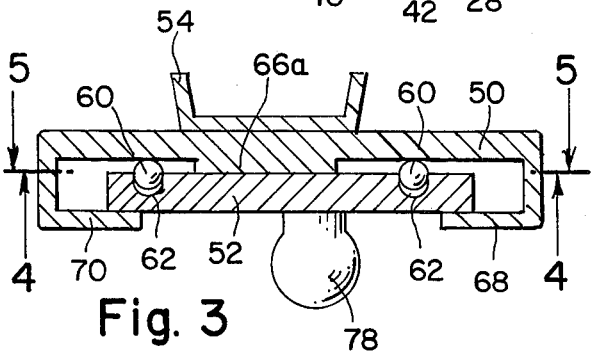
FIG. 3 is an enlarged cross-sectional view through one of the boot harnesses on the platform of FIG. 2.
Figure 4:
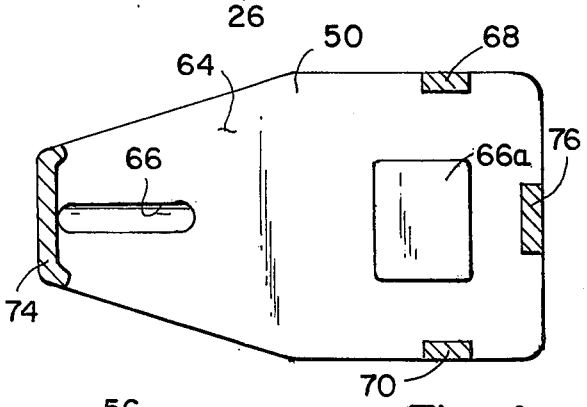
FIG. 4 is a cross-sectional view taken substantially along the plane indicated by line 4—4 of FIG. 3.
Figure 2:
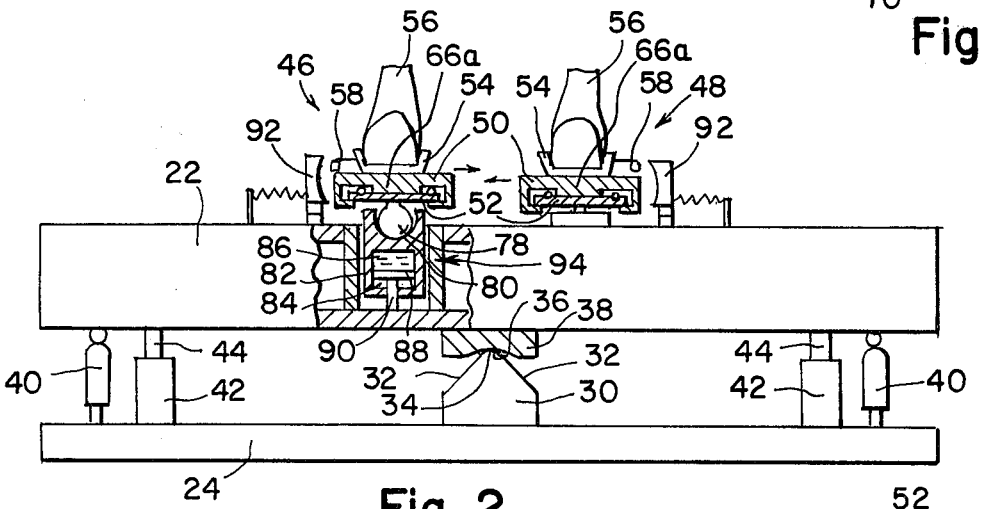
FIG. 2 is a front view in elevation of the platform portion of the apparatus of FIG. 1, with certain portions broken away and in section to illustrate the operation of the components of the apparatus.
Figure 5:
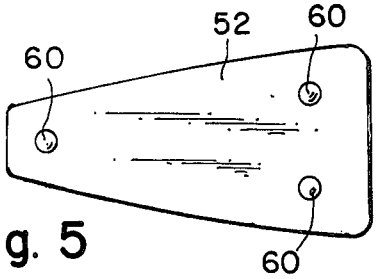
FIG. 5 is a cross-sectional view taken substantially along the plane indicated by line 5—5 of FIG. 3.

As shown in FIGS. 3 and 5, the top surface of the base plate 52 of each harness assembly 46 and 48 is generally triangular in shape and includes three steel ball bearings 60 rotatable in sockets 62. Upper boot platform 50 is complemental in shape to base plate 52, but longer in length and wider in width, and has a bottom surface 64 provided with a concave groove 66 and hollow area 66a receiving ball bearings 60. Depending from the lateral eges of bottom surface 64 of upper boot platform 50 are L-shaped wings 68, 70, 74 and 76 which extend beneath the bottom surface of base plate 52 to form with ball bearings 60, and groove 66 and area 66a, a reciprocating, sliding connection of upper boot platform 50 on base plate 52. Groove 66 enables a forward sliding motion while hollow area 66a enables sideways motion. Wings 68, 70, 74 and 76 limit the reciprocal sliding movement of boot platform 50 on base plate 52.

Depending from the bottom surface of each base plate 52 is a ball 78 received within a socket 80 in the top of a cylinder 82. Cylinder 82 has a central hollow chamber 84 filled with hydraulic fluid 86. A fixed piston having a head 88 and a rod 90 mounted in the interior of platform 22 is disposed in the hollow chamber 84 of cylinder 82.

Ball 78 and socket 80 provide a universal joint enabling base plate 52 and the entire harness assembly 46 or 48 to pivot relative to platform 22. Cylinder 82, piston head 88 and piston rod 90 in conjunction with hydraulic fluid 86 serve as a telescopic shock absorber to support the weight of the skier mounted in the harness assemblies and provide a smooth pivot for the foot to simulate a turn by the skier.

The use of the ski simulation apparatus 10 is as follows:

The skier locks his boots 56 to each of the harness assemblies 46 and 48 on sloping platform 22 in a conventional manner, as he would lock his boots to a pair of skis. The skier grasps poles 16 and places them against the tension of springs 18 on platform 22 straddling his body.

Projector 14 is then activated to project a motion picture or a series of slides on screen 12 of a particular ski slope. Accompanying the projection on screen 12 is sound instruction providing the skier with information as to how to ski and traverse the slope projected on screen 12. The instruction will not only impart information about the slope, but information as to when and how to execute a proper turn, etc.

When the projector is activated, an electric timing disc provided with the program and connected to an electric motor will periodically activate solenoids 42 whose plungers will alternately extend and be retracted to rock and vibrate platform 22 about point 34 on block 30, simulating the bumps and ride which would actually be experienced if the skier were traversing the slope projected on screen 12.

The boots 56 of the skier can reciprocate or slide sideways back and forth by virtue of the connection of upper boot platform 50 to base plate 52. Groove 66 and hollow area 66a on the lower surface 64 of upper boot platform 50 slide on relatively fixed ball bearings 60 in sockets 62 to simulate forward and sideways motion of the skier, while balls 78 connected to the bottom of base plate 52 disposed in sockets 80 enable the skier to simulate turns by pivoting boots 56, in accordance with the instructions in the program. Stops 68, 70, 74 and 76 limit the relative reciprocal motion of each harness.

If a stop is properly executed, one of the levers 58 attached to harness 54, depending upon whether a right or left-hand stop is executed, will strike a spring mounted switch 92 on platform shutting down the motor providing power to solenoids 42, to simulate a proper stop.

The weight of the skier is supported by the telescopic shock absorber assemblies 94 to absorb the deflection of the apparatus and redistribution of the weight of the skier during a simulated turn to simulate the true feeling and motion experienced while turning.

I claim:

1. Snow ski simulation apparatus comprising:

a sloping platform for supporting a skier, means for projecting an image of a ski slope in front of said platform, and means connected to said platform for simulating the traverse of the ski slope image projected in front of said platform, said simulation means including means for reciprocably mounting the boots of a skier supported on said platform, said reciprocal mounting means including a harness for a pair of boots, a base plate on said platform below each of said harnesses, each of said harnesses including stop means for limiting the reciprocal movement of said harnesses relative to said base plate, a plurality of ball bearings mounted on each of said base plates, and means on said boot harnesses reciprocally receiving said ball bearings, means for rotatably mounting each of said base plates, said base plate rotation mounting means including a ball and socket universal joint, the ball of said joint being connected to said base plate, and the socket being on said platform, said socket being formed in the top of a cylinder, said cylinder including a chamber filled with hydraulic fluid and a fixed piston therein, said cylinder being reciprocal relative to said piston against the force of said fluid.

2. Snow ski simulation apparatus in accordance with claim 1 wherein said simulation means includes means for vibrating said platform.

3. Snow ski simulation apparatus in accordance with claim 2 wherein said vibration means includes a support, a block on said support in contact with said platform at a point, and solenoid means between said support and platform for rocking said platform by pivoting it about the point contact with said block.

4. Snow ski simulation apparatus in accordance with claim 3 including a plurality of shock absorbers between said support and platform to dampen the vibration imparted to said platform by said solenoid means.

5. Snow ski simulation apparatus in accordance with claim 1 including a pair of ski poles mounted adjacent to said platform.

6. Snow ski simulation apparatus in accordance with claim 1 including means for vibrating said platform.

7. Snow ski simulation apparatus in accordance with claim 6 including means for reciprocably and rotatably mounting the boots of a skier supported on said platform.

8. Snow ski simulation apparatus in accordance with claim 7 including means on said boot mounting means for stopping operation of said vibration means in response to rotation thereof.

* * * * *